US009780508B2

(12) United States Patent
Trapp

(10) Patent No.: US 9,780,508 B2
(45) Date of Patent: Oct. 3, 2017

(54) TEST CABLE AND SOCKET ADAPTER FOR A TEST CABLE

(71) Applicant: TKR Spezialwerkzeuge GmbH, Gevelsberg (DE)

(72) Inventor: Marco Trapp, Iserlohn (DE)

(73) Assignee: TKR Spexialwerkzeuge GmbH, Gevelsberg (DE)

( * ) Notice: Subject to any disclaimer, the term of this patent is extended or adjusted under 35 U.S.C. 154(b) by 0 days.

(21) Appl. No.: 15/102,846

(22) PCT Filed: Sep. 8, 2015

(86) PCT No.: PCT/EP2015/070496

§ 371 (c)(1),
(2) Date: Jun. 8, 2016

(87) PCT Pub. No.: WO2016/062448

PCT Pub. Date: Apr. 28, 2016

(65) Prior Publication Data

US 2016/0315435 A1 Oct. 27, 2016

(30) Foreign Application Priority Data

Oct. 22, 2014 (DE) ..... 10 2014 115 384

(51) Int. Cl.
*H01R 13/62* (2006.01)
*H01R 31/06* (2006.01)
(Continued)

(52) U.S. Cl.
CPC ..... *H01R 31/06* (2013.01); *H01R 12/716* (2013.01); *H01R 12/75* (2013.01); *H01R 13/05* (2013.01);
(Continued)

(58) Field of Classification Search
CPC ..... H01R 12/716; H01R 13/6583
See application file for complete search history.

(56) References Cited

U.S. PATENT DOCUMENTS 4,643,511 A * 2/1987 Gawlik ..... H01R 11/289 439/755
4,719,440 A * 1/1988 Nakamura ..... H01F 5/04 174/94 R
(Continued)

FOREIGN PATENT DOCUMENTS

DE 29 07 957 A1 4/1981
WO 2013/176854 A1 11/2013

OTHER PUBLICATIONS

International Search Report dated Nov. 26, 2015 from corresponding PCT International Application PCT/EP2015/070496, 4 pages.
(Continued)

*Primary Examiner* — Xuong Chung Trans
(74) *Attorney, Agent, or Firm* — Flaster/Greenberg PC

(57) ABSTRACT

The invention relates to a test cable as well as a socket adapter for a test cable wherein the socket adapter has a plug strip with contact pins arranged at a distance from each other on a base body and having a socket contact section and a printed circuit board contact section and has a contact holding plate connected with the base body with individual through holes delimiting the printed circuit board contact sections from each other, each of which are designed for the fixed receiving of a lug arranged on a lead end.

12 Claims, 6 Drawing Sheets

(51) Int. Cl.

| | |
|---|---|
| ***H01R 12/71*** | (2011.01) |
| ***H01R 12/75*** | (2011.01) |
| ***H01R 13/05*** | (2006.01) |
| ***H01R 43/26*** | (2006.01) |

(52) U.S. Cl.
CPC ..... *H01R 43/26* (2013.01); *H01R 2201/20* (2013.01)

(56) References Cited

U.S. PATENT DOCUMENTS

| | | | | |
|---|---|---|---|---|
| 4,917,616 | A | 4/1990 | Demler et al. | |
| 6,869,321 | B1 | 3/2005 | Ashby et al. | |
| 7,632,157 | B2 * | 12/2009 | Imai | H01R 12/592 439/751 |
| 7,780,488 | B2 * | 8/2010 | Robertson | H01R 11/12 439/777 |
| 8,070,525 | B2 * | 12/2011 | Hou | H01R 13/506 439/660 |
| 8,197,281 | B2 * | 6/2012 | Yang | H01R 4/023 439/499 |

OTHER PUBLICATIONS

Written Opinion dated Nov. 26, 2015 from corresponding PCT International Application PCT/EP2015/070496, 6 pages.
PCT International Preliminary Report on Patentability dated May 4, 2017 in corresponding PCT International Application PCT/EP2015/070496 (17 pages).

* cited by examiner

TEST CABLE AND SOCKET ADAPTER FOR A TEST CABLE

BACKGROUND OF THE INVENTION

Field of the Invention

The invention relates to a test cable as well as a socket adapter for a test cable, wherein the socket adapter has a plug strip with contact pins arranged at a distance from each other on a base body and having a socket contact section and a printed circuit board contact section Description of Related Art In order to test the functionality of electrical control devices, which are used for example in the motor vehicle industry for controlling motors, it is required to connect a test device to the control devices. For motor vehicles, so-called Y cables or respectively test cables are used for this in auto service shops, which make it possible to test a control device while the motor vehicle is running. In this context, the test cable has a standardized socket connectable to the plug connection for connection of the test device to a plug connection of the control device. The socket is connected with a connection element for connection to the test device via a first cable or directly with the test device and with a second cable with a socket adapter, which serves to receive the socket connected to the plug connection of the control device in regular operation and thus to connect with the control device. The test cable thus enables the simultaneous connection of the test device and the socket to the plug connection of the control device.

The plug connections of the control devices are generally formed by a plug strip soldered with a printed circuit board of the control device. In this context, printed circuit board contact sections of the contact pins of the plug strip are soldered with the corresponding contacts on the printed circuit board so that the socket contact sections of the contact pins are then available for connection to the socket.

So that, in addition to the connection of the test device, the test cable also allows a connection with the socket associated to the printed circuit board plug of the control device, it is required to provide the test cable with a socket adapter, which is designed for the connection of the socket adapted to the printed circuit board plug. However, the use of a printed circuit board plug makes it necessary to connect each individual contact pin with a lead in the area of the printed circuit board contact section in order to provide a socket adapter, which is suitable for receiving the socket. However, a corresponding contacting, through soldering, is particularly complex and error-prone. Alternatively, it is also possible to purchase prefabricated, industrially produced plug units, which however result in high costs for the test cable due to the high production effort.

BRIEF SUMMARY OF THE INVENTION

The object of the invention is to provide a socket adapter, which can be produced cost-effectively using plug strips provided for printed circuit boards. Furthermore, the object of the invention is to provide a test cable, which, in addition to a connection for a test device, also has a socket adapter for connection of a socket connectable to a plug connection.

The object of the invention is solved by a socket adapter with the characteristics of claim 1 as well as a test cable with the characteristics of claim 9. Advantageous further embodiments of the socket adapter are shown in claims 2 to 8.

The socket adapter according to the invention has a plug strip with several contact pins arranged at a distance from each other on a base body. In this context, the contact pins of the plug strip provided for the connection with a printed circuit board have a printed circuit board contact section as well as a socket contact section. The printed circuit board contact section of the contact pins concerns the section of the contact pins, which was originally provided for the connection of the contact pins with the printed circuit board. However, the socket contact section of the contact pins serves for connection with a socket.

For the formation of the socket adapter according to the invention, a contact holding plate is connected with the base body of the plug strip. The contact holding plate has individual through holes, in which the printed circuit board sections of the contact pins are arranged delimited from each other. Moreover, each of the through holes is also designed for the fixed receiving of a lug arranged on a lead end. For example, the through holes can be dimensioned such that the lugs are held in a force-fitting manner in the through holes.

The use of a contact holding plate adapted to the printed circuit board contact sections allows the connection of the contact pins in the area of the printed circuit board contact sections individually to a lug, which is respectively connected with a lead end of a cable. In this context, the through holes separate not only the contact pins in the area of the printed circuit board sections from each other, but also lock the lugs on the contact pins as well as on the contact holding plate.

The socket adapter according to the invention is thus characterized in that, through the use of the contact holding plate, a plug strip normally provided only for use on a printed circuit board can be used to form a connection option for a socket in a cost-effective manner. The contact holding plate makes it possible to connect in a manner insulated from each other the individual leads provided with lugs reliably with the contact pins in the area of the printed circuit board contact sections of the plug strip. A complex soldering of the individual lead ends with the individual contact pins in the area of the printed circuit board contact sections as well as an also required insulation of the contacts can be foregone through the use of the contact holding plate.

The socket adapter according to the invention is thus characterized in that it can be produced in a particularly easy and cost-effective manner. Moreover, the individual contacts are insulated from each other in a particularly reliable manner so that disruptions do not occur.

According to a particularly advantageous further embodiment of the invention, the socket contact sections of the contact pins of the plug strip provided for the connection with the socket are arranged at least in sections within a housing connected with the base body for the receiving of the socket. The use of a housing increases the connection security between the socket and the socket contact sections. Moreover, the socket contact sections in the state connected with a socket are protected in a particularly reliable manner from outside influences. The connection of the housing, which is adapted particularly preferably to the shape of the socket, can generally take place with the base body in any manner. Thus, the housing can be glued or screwed with the base body. The housing can also be designed as one piece with the base body.

The design of the contact holding plate is adapted to the plug strip provided for the production of the socket adapter. The through holes of the contact holding plate delimited from each other ensure that the contact pins as well as the lugs are insulated from each other in the area of the printed circuit board contact sections. It is provided according to a particularly advantageous design of the invention that a spacer is arranged on the contact holding plate for spacing the adjacent lugs and/or lead end sections. One or more spacers, which are preferably arranged in the area between the through holes, increase between the lugs connected with the contact pins the protection against contact of the lugs and/or the lead ends amongst each other and also serve as a kink protection. The number, arrangement and design of the spacers can be freely selected depending on the position of the through holes with respect to each other.

According to a particularly advantageous embodiment of the invention, the spacer is formed by a web extending between the through holes. Such a web, which preferably extends mainly perpendicularly to the plane of the through holes, guarantees a particularly good securing of the position of the lugs and represents a particularly reliable protection against contact, wherein the height of the web can be adapted perpendicularly to the plane of the through holes to the length of the lugs.

A further improved securing of the position of the lugs and lead ends, an improved protection against contact of the lugs and lead ends amongst each other as well as a further improved kink protection are achieved according to a further development of the invention in that the webs extending between the through holes have projections arranged spaced from each other. The distance between the projections is preferably adapted to the distances between the through holes so that the adjacent lugs are insulated from each other in a particularly reliable manner and in a secured position. The projections can have a shape tapering toward the free end of the webs, whereby the installation of the lugs can be facilitated.

It is provided according to a further embodiment of the invention that the contact holding plate is connected with a locking plate, wherein the locking plate is designed for the form-fitting locking of the lugs arrangeable on the printed circuit board contact sections.

According to this further embodiment of the invention, the locking plate connected with the contact holding plate is designed such that the lugs are fastened on the contact holding plate opposite their mounting direction onto the contact pins in a form-fitting manner through the locking plate. A loosening of the lugs from the contact pins is prevented in a particularly reliable manner through this design of the invention. Moreover, the use of an individual position securing device for the lugs can be foregone through the locking plate, which can be brought into mechanical operative connection with all lugs.

The design of the locking plate for the form-fitting locking of the lugs is generally freely selectable. However, it is provided according to a particularly advantageous embodiment of the invention that the locking plate has a longitudinal groove adapted to the lugs such that an edge area of the longitudinal groove covers the lugs. The longitudinal groove of the locking plate generally enables the feed-through of the leads connected with the lugs. However, the longitudinal groove is simultaneously designed so narrow that it, with its circumferential edge facing the lugs, abuts against the lugs or against locking projections arranged on the lugs. In connection with one or more webs provided according to the above further embodiment designed as a spacer, which are also designed with projections, a clamping of the cables between the webs, the projections and the longitudinal groove can furthermore be achieved depending on the design of the projections so that a stress relief is provided by the locking plate when the web or webs of the contact holding plate in the installed state of the socket adapter extend through the longitudinal groove of the locking plate.

It is provided according to a further embodiment of the invention that the locking plate has at least one, preferably two, webs arranged parallel to the longitudinal groove and on both sides of the longitudinal groove, which progress particularly preferably mainly perpendicularly to the plane of the longitudinal groove, of the top side of the locking plate. The webs serve in a supplementary manner as protection against contact as well as for securing the position of the lead end sections. Moreover, the webs form a kink protection, which prevents a lead-damaging kinking of the cables. A combination of the webs arranged on both sides of the longitudinal groove on the locking plate with one or more spacers provided according to an advantageous further embodiment and designed as webs on the contact holding plate improves the securing of the position as well as the kink protection in a supplementary manner, wherein the lead ends are arranged between the webs of the contact holding plate and the locking plate.

The test cable according to the invention for connecting a test device to a plug connection has a socket connectable to the plug connection. A first cable with a connection element for connecting the test device and a second cable with a socket adapter according to one of claims 1 to 8 extend from this socket. The test cable according to the invention can be produced in a particularly easy and cost-effective manner based on the use of a socket adapter shown above, since the socket adapter can be produced using standardized plug strips originally provided for connection with printed circuit boards. The connection element, a plug or a socket for connecting to the test device as well as the socket connectable to the plug connection already are standardized and thus cost-effectively available components, so that the test cable can be produced in a simple manner.

BRIEF DESCRIPTION OF THE SEVERAL VIEWS OF THE DRAWINGS

An exemplary embodiment of the invention is explained below with reference to the drawing. The drawings show in.

DETAILED DESCRIPTION OF THE INVENTION

Figure 1:
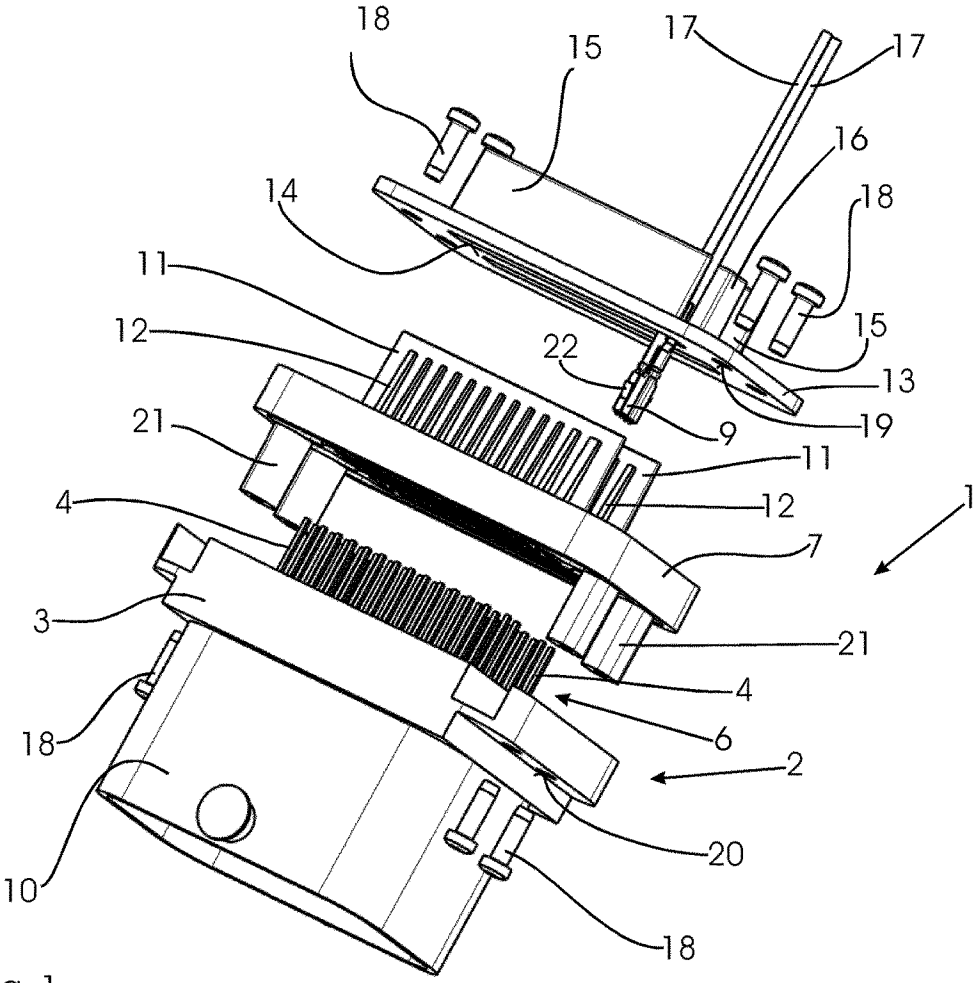
FIG. 1 in an exploded representation, an embodiment of a socket adapter with a contact holding plate and a locking plate.
Figure 2:
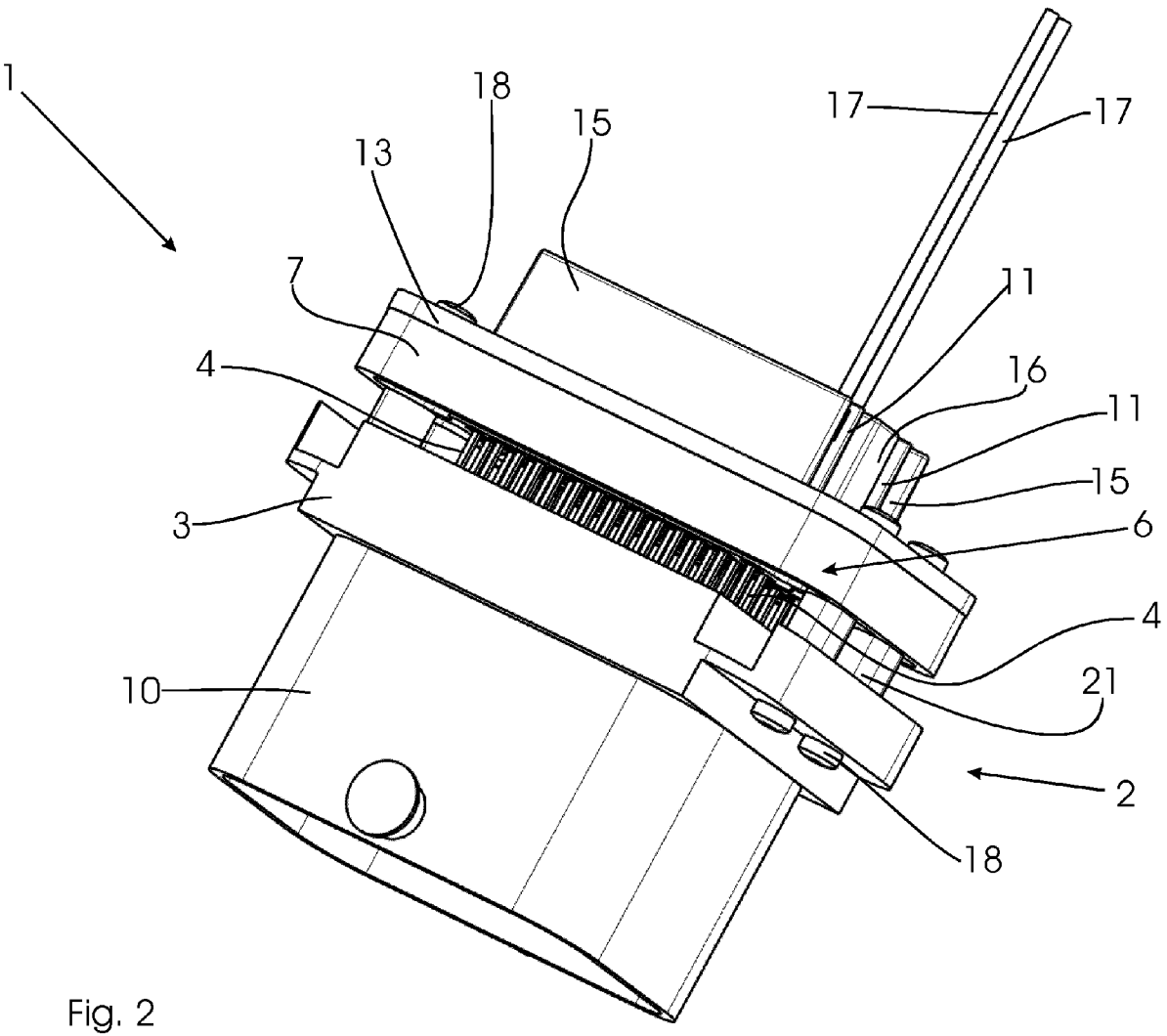
FIG. 2 a perspective view of the socket adapter in FIG. 1 in the installed state.
Figure 3:
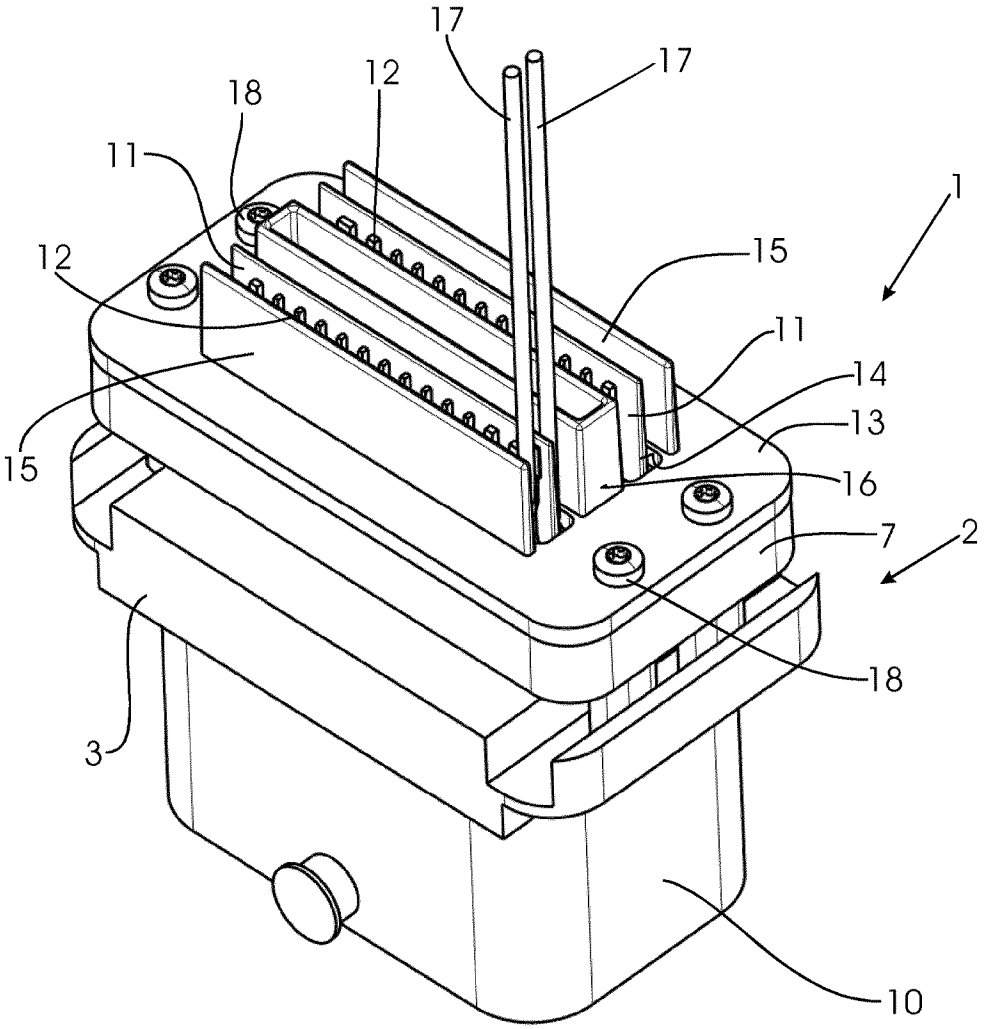
FIG. 3 a further perspective representation of the socket adapter in FIG. 1 in the installed state.
Figure 4:
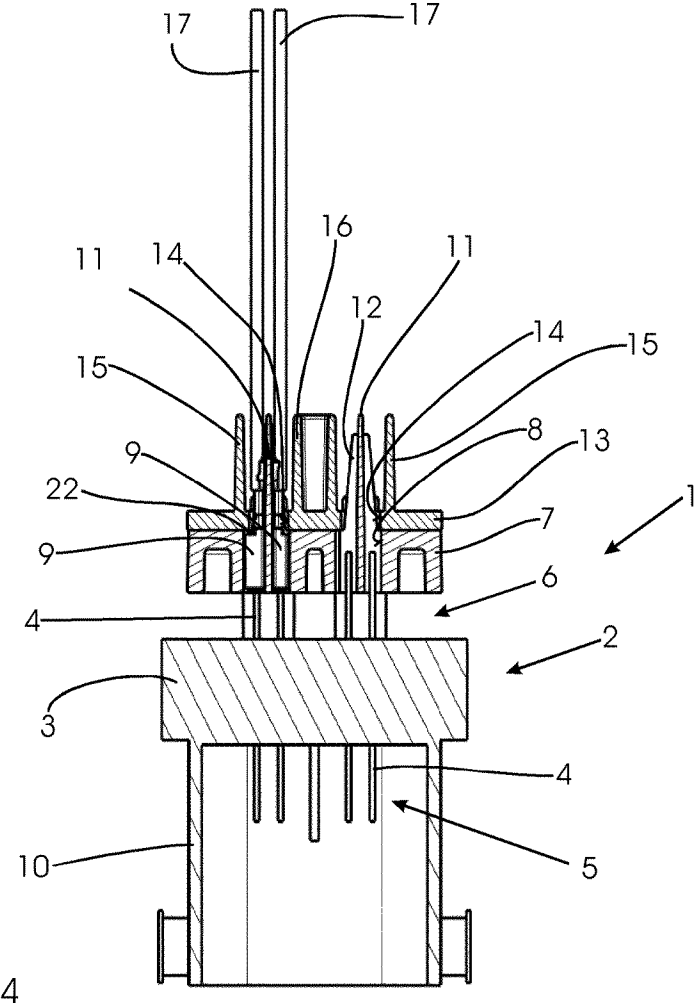
FIG. 4 a view of a cross-section of the socket adapter in FIG. 1.

FIGS. 1 to 4 show an embodiment of a socket adapter 1, which can be used to form a test cable (not shown here). The test cable serves in particular to connect a test device (not shown here) to a control device of a motor vehicle (also not shown here), wherein the test cable is designed as a Y cable for testing the control device while the motor vehicle is running. It has a socket (not shown here) for connecting to a plug strip of the control device as well as two cables leading away from the socket, one of which has a connection element for connecting to the test device. The socket adapter 1 for receiving the socket arranged in regular operation on the plug strip of the control device is arranged on the end of the other cable.

The socket adapter 1 has a plug strip 2 normally provided for connection with a printed circuit board, which has a plurality of spaced contact pins 4 arranged on a base body 3. On one side of the base body 3, the contact pins 4 form a socket contact section 5 arranged within a housing 10, which is designed according to the type of a plug for receiving the socket (not shown here). On the other side of the base body 3, the contact pins 4 form a printed circuit board contact section 6, which normally serves to solder the individual contact pins 4 with corresponding contacts on the printed circuit board.

Figure 5B:
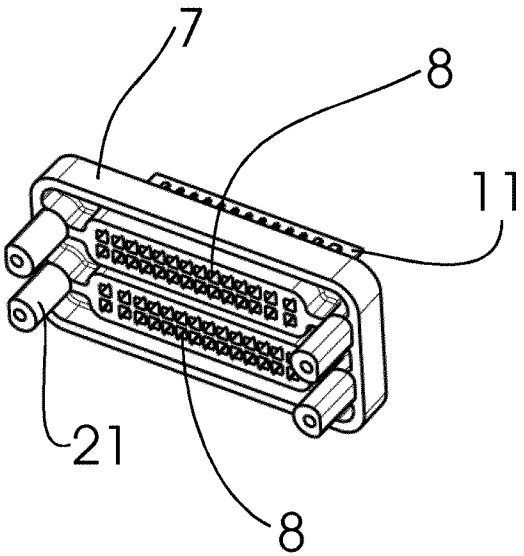
FIG. 5*b* a second perspective view of the contact holding plate of the socket adapter in FIG. 1.
Figure 5A:
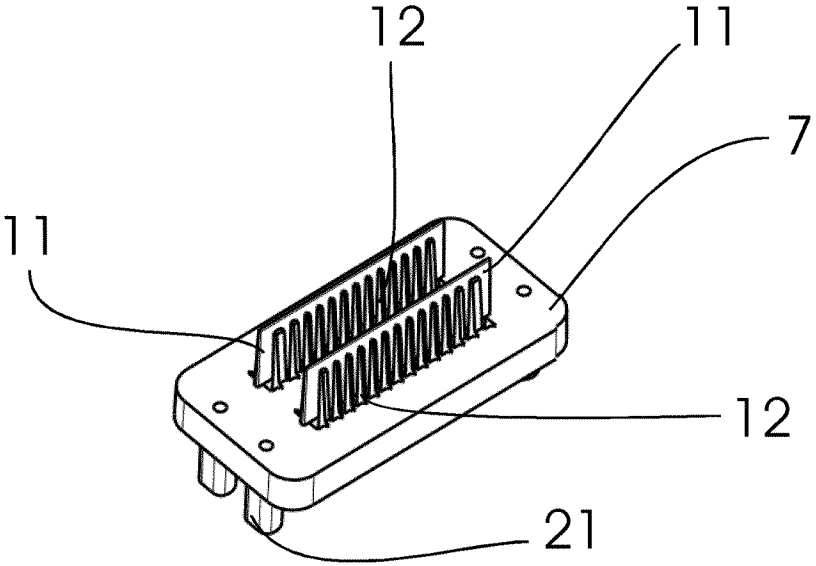
FIG. 5*a* a first perspective view of the contact holding plate of the socket adapter in FIG. 1.
Figure 6B:
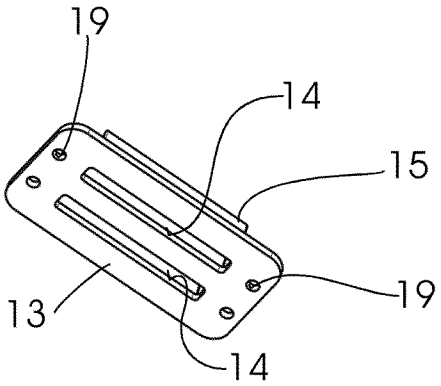
FIG. 6*b* a second perspective view of the locking plate of the socket adapter in FIG. 1.
Figure 6A:
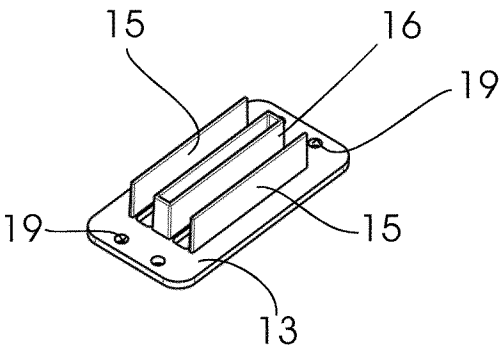
FIG. 6*a* a first perspective view of the locking plate of the socket adapter in FIG. 1.

For connecting the contact pins 4 with the leads 17 of a cable (not shown here), the socket adapter 1 has a contact holding plate 7 having a plurality of through holes 8 (see FIGS. 5*a* and 5*b*). The arrangement of the through holes 8 corresponds with the arrangement of the contact pins 4 on the base body 3 of the plug strip 2. The contact holding plate 7 is arranged on the contact pins 4 such that they are arranged in sections within the through hole 8. Locking bolts 18 extending through openings 20 on the base plate 3, which engage in corresponding receiving sections 21 on the contact holding plate 7, serve to secure the position of the contact holding plate 7 on the base body 3.

The through holes 8 thus reliably space and insulate the individual contact pins 4 from each other and are adapted to the form of lugs 9, which are arranged on the ends of the leads, so that the lugs 9 are held in their position clamped on the printed circuit board contact sections 6 of the contact pins 4. The through holes 8 are arranged in four parallel rows in the longitudinal direction of the contact holding plate 7, wherein two rows are separated from each other by respectively one web 11 extending in the direction of the longitudinal axis of the contact holding plate 7. The web 11 thus serves as protection against contact as well as for supplementary securing of the position of the lug 9. Furthermore, projections 12 corresponding with the distance to the through hole 8 are arranged on the webs 11. These space, seen in the direction of the longitudinal axis of the contact holding plate 7, the lugs 9 arrangeable on the contact pins 4 and the lead end sections. The web 11 thus serves in connection with the projections 12 as a protection against contact and kinks.

The protection against contact and kinks is improved in a supplementary manner by a locking plate 13 provided for securing the position of the lugs 9 on the contact pins 4. The locking plate 13 has two longitudinal grooves 14 adapted to the webs 11, through which the leads 17 can be guided. The width of the longitudinal groove 14 is to be dimensioned such that the longitudinal groove 14 with its edge area facing the contact holding plate 7 abuts against the locking projections 22 of the lugs 9 and thus forms a pull-out protection for the lugs 9. The locking plate 13 is connected with the contact holding plate 7 via locking bolts 18, wherein the locking bolts 18 extend through openings 19 on the locking plate 13 into the receiving sections 21 on the contact holding plate 7.

Besides the longitudinal grooves 14 arranged adjacent to each other, the locking plate 13 has webs 15, 16 extending from a top side of the locking plate 13, which progress parallel to the longitudinal grooves 14. In the installed state of the socket adapter 1, the webs 11 of the contact holding plate 7 protrude through the longitudinal grooves 14 on the locking plate 13 so that the webs 15, 16 on the locking plate 13 form a reliable kink protection together with the webs 11. Moreover, the tapered design of the projections 12 on the webs 11 guarantees a clamping of the leads 17 between the webs 11 on the contact holding plate 7 and the webs 15, 16 on the locking plate 13, whereby a stress relief is formed.

REFERENCE LIST

1 Socket adapter
2 Plug strip
3 Base body
4 Contact pin
5 Socket contact section
6 Printed circuit board contact section
7 Contact holding plate
8 Through hole
9 Lug
10 Housing
11 Spacer/web
12 Projections
13 Locking plate
14 Longitudinal groove
15 Web
16 Web
17 Lead
18 Locking bolt
19 Opening
20 Opening
21 Receiving section
22 Locking projection

I claim:

1. A socket adapter for a test cable, with a plug strip with contact pins arranged at a distance from each other on a base body and having a socket contact section and a printed circuit board contact section;

a contact holding plate connected with the base body with individual through holes that delimit sections of the printed circuit board contact section from each other, each of the through holes being designed for the fixed receiving of a lug arranged on a lead end; and a locking plate connected with the contact holding plate, wherein the locking plate is designed for form-fitting locking of the lugs arrangeable on the sections of the printed circuit board contact section.

2. The socket adapter according to claim 1, wherein the socket contact section of the contact pins is arranged at least in sections within a housing connected with the base body for receiving the socket.

3. The socket adapter according to claim 1, wherein a spacer for spacing adjacent lugs and/or lead end sections is arranged on the contact holding plate.

4. The socket adapter according to claim 3, wherein the spacer is formed by a web extending between the through holes.

5. The socket adapter according to claim 4, wherein the web has projections arranged spaced from each other.

6. The socket adapter according to claim 1, wherein the locking plate has a longitudinal groove adapted to the lugs such that an edge area of the locking plate covers the lugs.

7. The socket adapter according to claim 6, wherein the locking plate has at least one web arranged parallel to the longitudinal groove and on a side of the longitudinal groove, which progresses mainly perpendicularly to a plane of the longitudinal groove.

8. The socket adapter for a test cable according to claim 7, wherein there are at least two webs arranged parallel to the longitudinal groove on both sides thereof.

9. A test cable for connecting a test device to a plug connection with a socket connectable to the plug connection, the socket being connected with a connection element for connecting to the test device via a first cable and connected with a socket adapter via a second cable according to claim 1.

10. A socket adapter for a test cable, with a plug strip with contact pins arranged at a distance from each other on a base body and having a socket contact section and a printed circuit board contact section;

a contact holding plate connected with the base body with individual through holes that delimit sections of the printed circuit board contact section from each other, each of the through holes being designed for fixed receiving of a lug arranged on a lead end; and a locking plate connected with the contact holding plate, wherein the locking plate is designed for form-fitting locking of the lugs arrangeable on the sections of the printed circuit board contact section, wherein the locking plate has a longitudinal groove adapted to the lugs such that an edge area of the locking plate covers the lugs.

11. A socket adapter for a test cable, with a plug strip with contact pins arranged at a distance from each other on a base body and having a socket contact section and a printed circuit board contact section;

a contact holding plate connected with the base body with individual through holes that delimit sections of the printed circuit board contact section from each other, each of the through holes being designed for the fixed receiving of a lug arranged on a lead end; and a locking plate connected with the contact holding plate, wherein the locking plate is designed for form-fitting locking of the lugs arrangeable on the sections of the printed circuit board contact section, wherein the locking plate has a longitudinal groove adapted to the lugs such that an edge area of the locking plate covers the lugs, the locking plate has at least one web arranged parallel to the longitudinal groove and on a side of the longitudinal groove, which progresses mainly perpendicularly to a plane of the longitudinal groove.

12. The socket adapter for a test cable according to claim 11, wherein there are at least two webs arranged parallel to the longitudinal groove on both sides thereof.

* * * * *